US008199943B2

(12) United States Patent
Bäuml et al.

(10) Patent No.: US 8,199,943 B2
(45) Date of Patent: Jun. 12, 2012

(54) HEARING APPARATUS WITH AUTOMATIC SWITCH-OFF AND CORRESPONDING METHOD

(75) Inventors: Robert Bäuml, Eckental (DE); Ulrich Kornagel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1240 days.

(21) Appl. No.: 11/986,038

(22) Filed: Nov. 19, 2007

(65) Prior Publication Data

US 2008/0123882 A1 May 29, 2008

(30) Foreign Application Priority Data

Nov. 23, 2006 (EP) ..... 06024329

(51) Int. Cl.
*H04R 25/00* (2006.01)

(52) U.S. Cl. ..... 381/312
(58) Field of Classification Search ..... 381/312
See application file for complete search history.

(56) References Cited

U.S. PATENT DOCUMENTS

| | | | | |
|---|---|---|---|---|
| 4,955,729 | A | 9/1990 | Marx | |
| 6,914,994 | B1 | 7/2005 | Shennib et al. | |
| 7,151,838 | B2 * | 12/2006 | Galler et al. | 381/312 |
| 2005/0254676 | A1 | 11/2005 | Rass et al. | |
| 2007/0036377 | A1 * | 2/2007 | Stirnemann | 381/315 |

FOREIGN PATENT DOCUMENTS

| | | | |
|---|---|---|---|
| DE | 3742529 | C1 | 2/1989 |
| DE | 10 2004 023 049 | A1 | 12/2005 |
| EP | 0674466 | A1 | 3/1995 |
| EP | 0 964 603 | A1 | 12/1999 |
| WO | WO 03/024148 | A2 | 3/2003 |

* cited by examiner

*Primary Examiner* — David Vu
*Assistant Examiner* — Brandon Fox

(57) ABSTRACT

The aim is to be able to at least partially switch off a hearing apparatus and in particular a hearing device in a simple manner. To this end, provision is made to generate a predetermined acoustic signal through the hearing apparatus. The acoustic signal is received by a receiving device, after it has passed through an acoustic path. This acoustic path changes depending on whether the hearing apparatus is being worn or not. The hearing apparatus is at least partially switched off as a function of the received, acoustic signal. A hearing device thus automatically switches off for instance when it is not being worn.

17 Claims, 1 Drawing Sheet

HEARING APPARATUS WITH AUTOMATIC SWITCH-OFF AND CORRESPONDING METHOD

CROSS REFERENCE TO RELATED APPLICATIONS

This application claims priority of European Patent Office application No. 06024329.2 EP filed Nov. 23, 2006, which is incorporated by reference herein in its entirety.

FIELD OF INVENTION

The present invention relates to a hearing apparatus comprising a signal generator, an acoustic converter for converting an electrical signal of the signal generator into an acoustic signal, a receiving device for receiving the acoustic signal and a signal processing facility for processing a receive signal from the receiving device. The present invention further relates to a corresponding method for at least partially switching off a hearing apparatus. The term hearing apparatus is understood here to mean in particular a hearing device, but also a headset or earphones for instance.

BACKGROUND OF INVENTION

Hearing devices are wearable hearing apparatuses used to assist the hard-of-hearing. To meet the numerous individual requirements, different designs of hearing device are provided, such as behind-the ear (BTE) hearing devices, in-the-ear (ITE) hearing devices and concha hearing devices. The typical configurations of hearing device are worn on the outer ear or in the auditory canal. Above and beyond these designs however there are also bone conduction hearing aids, implantable or vibro-tactile hearing aids available on the market. In such hearing aids the damaged hearing is stimulated either mechanically or electrically.

Hearing devices principally have as their main components an input converter, an amplifier and an output converter. The input converter is as a rule a sound receiver, e.g. a microphone, and/or an electromagnetic receiver, e.g. an induction coil. The output converter is mostly implemented as an electroacoustic converter, e.g. a miniature loudspeaker, or as an electromechanical converter, e.g. bone conduction earpiece. The amplifier is usually integrated into a signal processing unit. This basic structure is shown in FIG. 1 using a behind-the ear hearing device as an example. One or more microphones 2 for recording the sound from the surroundings are built into a hearing device housing 1 worn behind the ear. A signal processing unit 3, which is also integrated into the hearing device housing 1, processes the microphone signals and amplifies them. The output signal of the signal processing unit 3 is transmitted to a loudspeaker or earpiece 4 which outputs an acoustic signal. The sound is transmitted, if necessary via a sound tube which is fixed with an otoplastic in the auditory canal, to the hearing device wearer's eardrum. The power is supplied to the hearing device and especially to the signal processing unit 3 by a battery 5 also integrated into the hearing device housing 1.

Hearing systems or hearing apparatuses worn on the ear are, as illustrated above, generally powered by means of a battery. As a result of the restricted service life of a battery, the system should be deactivated when it is not required. This is particularly the case when the system is removed from the ear.

A hearing system has, until now, conventionally been deactivated manually. With hearing devices, the battery compartment is generally opened for this purpose.

The publication EP 0 964 603 A1 discloses a method for automatically controlling a hearing device, in which method control parameters are continuously and dynamically generated at least as a function of the ambient noise. The generation of control parameters can be influenced by additional parameters such as the time of day, ambient temperature, ambient humidity and suchlike.

The patent application DE 10 2004 023 049 B4 also indicates a hearing apparatus having a switching arrangement for switching it on and off, with the switching arrangement including a resistance sensor for capturing an electrical volume-dependent load resistor. The hearing device can also include a temperature sensor, a pressure sensor or an acoustic sensor, in order to automatically detect its current state. If, for instance, it is being worn, an increased temperature or increased pressure can be measured. The state where the hearing device is in use can however also be recognized at the acoustic input level. The hearing device is automatically switched on or off as a function of the respective sensor signal and/or transferred into a standby mode.

The publications U.S. Pat. No. 4,955,729 A and US 2005/0254676 A1 disclose hearing devices which are automatically switched on and off with the temperature, pressure, resistance or an acoustic signal.

A hearing device is also known from patent application DE 37 42 529 C1, in which an acoustic feedback signal, an upper and lower temperature limit, the transition from a moved to an unmoved state or the oxygen partial pressure inside and/or outside of the auditory canal is used as the trigger criterion for the actuation of a switch acting on a change in state during removal of the hearing device from its position when in use. An acoustic feedback signal however only then results if the amplification of the hearing device is set sufficiently high. The acoustic path between the receiver and the microphone also determines, in a barely comprehensible fashion, the frequency and/or the frequency range of the whistling tone produced as a result of the feedback.

SUMMARY OF INVENTION

The object of the present invention consists in proposing a hearing apparatus which can be automatically switched on and off in a reliable fashion without any great switching-related effort, depending on whether it is being worn or not.

This object is achieved in accordance with the invention by a hearing apparatus having a signal generator, an acoustic converter for converting an electrical signal of the signal generator into an acoustic signal, a receiving device for receiving the acoustic signal and a signal processing facility for processing a receive signal from the receiving device, with the electrical signal of the signal generator being a predetermined switch-off signal and the signal processing facility at least partially switching off the hearing apparatus as a function of the switch-off signal transmitted by way of the acoustic converter and the receiving device.

Provision is also made in accordance with the invention for a method for at least partially switching off a hearing apparatus by generating a predetermined acoustic signal through the hearing apparatus, receiving the acoustic signal through the hearing apparatus and at least partially switching off the hearing apparatus as a function of the received, acoustic signal.

It is thus advantageously possible to capture the change in an acoustic path with a hearing apparatus, which results when positioning the hearing apparatus on the ear or when removing it from the ear, and to use this change to switch the hearing apparatus. As each hearing apparatus generally has an acoustic converter and a receiving device, these can also be used to measure the acoustic path, so that these components acquire an additional functionality. Separate hardware components for measuring the acoustic path are then not necessary.

The acoustic signal is preferably a subsonic noise or an ultrasound. The acoustic path between the acoustic converter and the receiving device (typically microphone) can herewith be monitored at short intervals, without disturbing the wearer of the hearing apparatus.

The acoustic signal can also be an ultrasound noise. The ultrasound signal can be clearly identified by the harmonics, so that a distinction can be reliably made between the switch-off signal or its acoustic equivalent and the ambient noises.

It is generally expedient for the switch-off signal to be predetermined in terms of its temporal and spectral progression. The switch-off signal on the receive side is herewith easy to identify.

The switch off signal can be a sinusoidal signal with a frequency above 18 kHz for instance. A distinction can be readily made between a pure ultrasound sinusoidal signal of this type and interference noises.

Alternatively, the switch-off signal can however also exhibit a continuously rising or falling spectral characteristic. Chirp signals of this type are easy to perceive in noisy environments.

In a special embodiment, the signal processing facility comprises a so-called matched filter, which is attuned to the switch-off signal. The switch-off signal can herewith be detected without any great computational effort.

In accordance with another embodiment, the signal processing facility can capture frequency-selective level changes in the received acoustic signal and use them for the switch-off signal. The frequency-selective analysis of the received, acoustic signal allows a more robust detection to be achieved in the presence of interference noises.

The acoustic path on the hearing apparatus conventionally passes from the acoustic converter through the air to the receiving device. It can however also pass at least partially through the housing of the hearing apparatus. The transmission function of the structure-borne sound transmitted through the housing of the hearing apparatus changes when the housing rests against the body of the wearer of the hearing apparatus. Conventional, known transmitters and receivers are suited to structure-borne sound transmission via the housing. A piezo component can be used for instance as a transmitter and/or receiver. Other vibration sensors can however also be used.

BRIEF DESCRIPTION OF THE DRAWINGS

The present invention is described in more detail with reference to the appended drawings, in which.

DETAILED DESCRIPTION OF INVENTION

The exemplary embodiments illustrated in more detail below represent preferred embodiments of the present invention.

Figure 1:
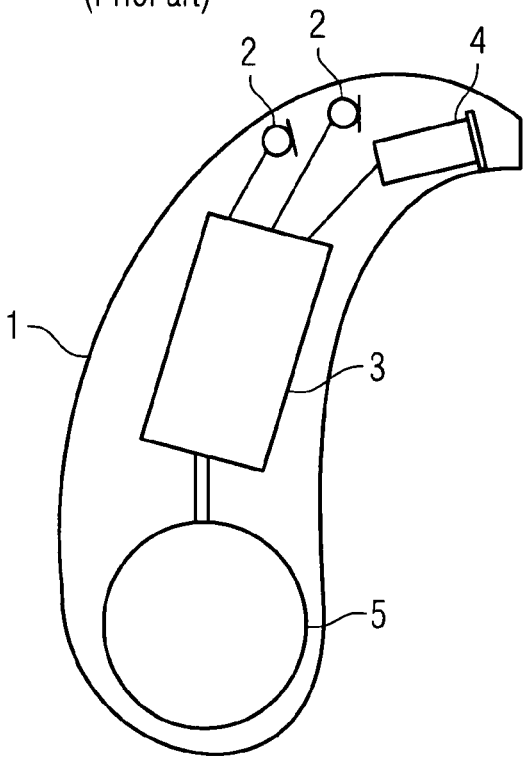
FIG 1 (Prior art)
FIG. 1 shows the main design of a hearing device as claimed in the prior art.
Figure 2:
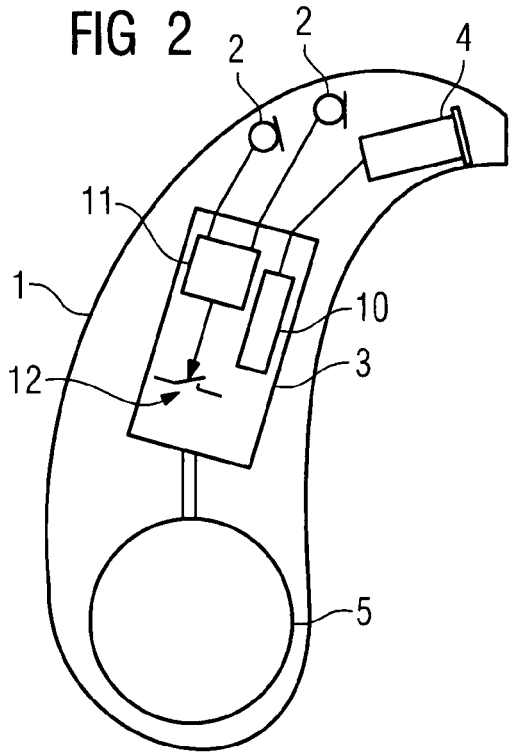
FIG. 2 shows an inventive behind-the-ear hearing device with an automatic switch-off device and FIG. 3 shows an inventive in-the-ear hearing device being worn by a user.

The behind-the-ear hearing device reproduced schematically in FIG. 2 essentially exhibits the same components as the hearing device in FIG. 1. In this respect, reference is made to the description of FIG. 1. Here, however, the signal processing unit 3 additionally comprises a signal generator 10, in order to generate a predetermined switch-off signal. This switch-off signal is routed to the loudspeaker and/or receiver 4 and is converted there into an acoustic signal.

The signal processing unit 3 also includes a filter unit, e.g. a matched filter 11, which is attuned to the switch-off signal of the signal generator 10. The output signal of the matched-filter 11 is used here to switch the signal processing unit 3. This is symbolized in FIG. 2 by a switch 12. This control element and/or switch 12 allows the signal processing facility to be completely or partially switched off for instance. Individual components of the hearing device or the hearing device itself can also be at least partially switched off.

According to the fundamental idea behind the present invention, the system and/or the hearing device deactivates itself after removal out of the ear and/or from the ear. To this end, an acoustic signature is emitted from the receiver 4 in an inaudible acoustic frequency range (subsonic noise, ultrasound), and is recorded by the microphones 2, which function as a receiving device for the acoustic signature. The acoustic signal passes through an acoustic path, which, when the hearing device is not being worn, in the case of the behind-the-ear hearing device in FIG. 2, leads from the receiver 4 through a sound tube (not shown) and from the end thereof via the air path to the microphones 2. If the hearing device is being worn, the sound tube plugs into the auditory canal, thereby changing the acoustic path from the receiver 4 to the microphones 2. It changes particularly significantly in the case of a closed supply.

The change in the acoustic path from the receiver 4 to the microphones 2 is detected in the hearing device. By way of example, when the hearing device is being worn, the acoustic signature does not arrive at the microphones 2, while, when the hearing device is not being worn, said acoustic signal is registered via the matched filter 11. The general case nevertheless consists in different input levels of the acoustic signature being able to be registered as a function of the wearing state of the hearing device. The system and/or parts thereof are then deactivated as a function of this level or switched into a standby mode. Conversely, if the hearing system is attached to the ear, it is activated as a result of the change in the acoustic path.

Figure 3:
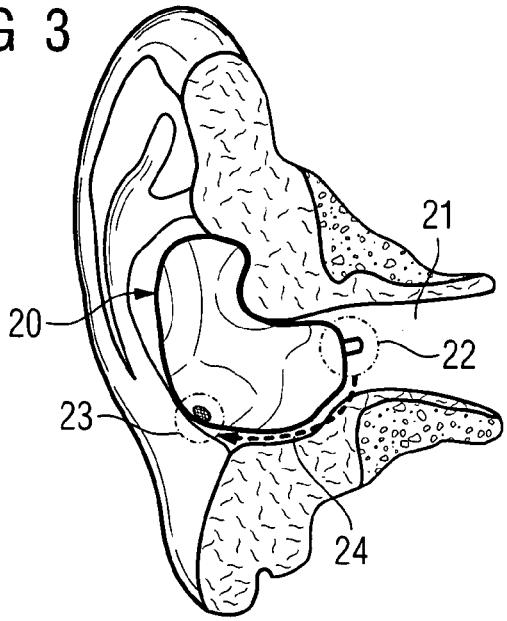

FIG. 3 shows an inventive in-the-ear hearing device 20. It is inserted into an auditory canal 21. The receiver 22 of the hearing device 20 points toward the eardrum (not shown) in the auditory canal 21. By contrast, the microphone 23 of the hearing device 20 is directed outwards. An acoustic path 24 from the receiver 22 to the microphone 23 thus results for the acoustic signature in the and/or along the housing of the hearing device 20 and/or the wall of the auditory canal 21, against which the hearing device 20 rests.

With an in-the-ear hearing device 20, the acoustic path thus clearly changes during removal from the ear and/or insertion into the ear. When the hearing device is being worn, the acoustic path 24 namely passes at least partially through the solid body, while, when the hearing device is not being worn, it generally passes through the air.

The term acoustic signature is understood here to mean a temporally and spectrally defined signal sequence. It is combined such that it clearly differs from natural signal sequences. A sinusoidal tone with a frequency above 18 kHz is considered as acoustic signal for instance. With a corresponding hearing loss, this frequency can also be lower.

An ultrasound noise with the respective harmonics is also conceivable as an acoustic signature. Furthermore, an acoustic signature can also be formed with spectrally discrete (e.g.

scales) or spectrally continuous (e.g. chirp) characteristics by means of a special ultrasound tone sequence.

The detector (reference character 11 in FIG. 2) of the acoustic signature is, comparable to a matched filter, attuned to the acoustic signature. It only responds to this signature. In particular, a broadband level change in the signature signal received on the microphone(s) 2 can be detected therewith. Alternatively, the frequency-selective level changes can also be detected on the basis of the change in the acoustic path from the receiver 4, 22 to the microphone 2, 23.

One particular advantage of this hearing apparatus according to the invention and/or method according to the invention lies in there being no additional hardware requirement for the automatic switching. Instead, the acoustic converter and receiving devices (microphones), which are already built into the hearing apparatus, are used as transmitters and receivers.

The invention claimed is:

1. A hearing apparatus, comprising:

a signal generator that generates an electrical predetermined switch-off signal;

an acoustic converter that converts the electrical signal into an acoustic signal;

a receiving device that receives the acoustic signal; and a signal processing facility that processes the received acoustic signal, the signal processing facility at least partially switches off the hearing apparatus as a function of the switch-off signal transmitted by way of the acoustic converter and the receiving device, wherein the signal processing facility comprising a matched filter attuned to the switch-off signal.

2. The hearing apparatus as claimed in claim 1, wherein the acoustic signal is an infrasonic signal or an ultrasound signal.

3. The hearing apparatus as claimed in claim 1, wherein the acoustic signal is an ultrasound noise.

4. The hearing apparatus as claimed in claim 1, wherein the switch-off signal is predetermined in terms of its temporal and spectral progression.

5. The hearing apparatus as claimed in claim 1, wherein the switch-off signal is a sinusoidal signal above 18 kHz.

6. The hearing apparatus as claimed in claim 1, wherein the switch-off signal exhibiting a continuous rising or falling spectral characteristic.

7. The hearing apparatus as claimed in claim 1, wherein the signal processing facility capturing frequency-selective level changes to the received acoustic signal and using the captured changes for the switch-off process.

8. The hearing apparatus as claimed in claim 1, wherein the generated electrical signal is in result of removing the hearing apparatus from a wearer.

9. A method for at least partially switching off a hearing apparatus, comprising:

providing a switch that at least partially switches off the hearing apparatus;

generating a predetermined first acoustic signal by the hearing apparatus;

receiving the first acoustic signal by the hearing apparatus; and via the switch: at least partially switching off the hearing apparatus as a function of the received first acoustic signal, wherein the signal processing facility comprising a matched filter attuned to the switch-off signal.

10. The method as claimed in claim 9, wherein the first acoustic signal is an infrasonic or an ultrasound signal.

11. The method as claimed in claim 9, wherein the first acoustic signal is an ultrasound noise.

12. The method as claimed in claim 9, wherein the first acoustic signal is predetermined in terms of its temporal and spectral progression.

13. The method as claimed in claim 9, wherein the first acoustic signal is sinusoidal and lying above 18 kHz.

14. The method as claimed in claim 9, wherein the first acoustic signal exhibiting a continuous rising or falling spectral characteristic.

15. The method as claimed in claim 9, wherein frequency-selective level changes in the received first acoustic signal being captured and used for switching-off the hearing apparatus.

16. The method as claimed in claim 9, wherein the first acoustic signal is generated in response to the hearing apparatus being removed from a wearer.

17. The method as claimed in claim 9, further comprising:

generating a second predetermined acoustic signal by the hearing apparatus in response to the hearing apparatus being put onto the wearer;

receiving the second acoustic signal by the hearing apparatus; and turning on the hearing apparatus as a function of the received second acoustic signal.

* * * * *